US010633927B2

(12) United States Patent
Nan et al.

(10) Patent No.: US 10,633,927 B2
(45) Date of Patent: Apr. 28, 2020

(54) INTERNAL REAMER FOR ANCHOR SHAFT HOLE FOR MINING

(71) Applicant: HENAN POLYTECHNIC UNIVERSITY, Jiaozuo, Henan (CN)

(72) Inventors: Hua Nan, Henan (CN); Mingyang Song, Henan (CN); Saibo Kong, Henan (CN)

(73) Assignee: HENAN POLYTECHNIC UNIVERSITY, Jiaozuo (CN)

( * ) Notice: Subject to any disclaimer, the term of this patent is extended or adjusted under 35 U.S.C. 154(b) by 0 days.

(21) Appl. No.: 16/542,738

(22) Filed: Aug. 16, 2019

(65) Prior Publication Data

US 2019/0368275 A1 Dec. 5, 2019

Related U.S. Application Data

(63) Continuation of application No. PCT/CN2017/113700, filed on Nov. 30, 2017.

(51) Int. Cl.
*E21B 10/32* (2006.01)
*E21B 7/30* (2006.01)

(52) U.S. Cl.
CPC ..... *E21B 10/325* (2013.01); *E21B 7/30* (2013.01)

(58) Field of Classification Search
CPC ..... E21B 10/325; E21B 10/327; E21B 10/32; E21B 10/26; E21B 7/30; E21B 7/28; E21D 20/00; E21D 20/003; E02D 5/74
See application file for complete search history.

(56) References Cited

U.S. PATENT DOCUMENTS

2005/0205305 A1* 9/2005 Stout ..... E21B 10/32 175/292
2015/0083406 A1 3/2015 Nelson et al.

FOREIGN PATENT DOCUMENTS

| | | | |
|---|---|---|---|
| CN | 2835562 | Y | 11/2006 |
| CN | 1963043 | A | 5/2007 |
| CN | 202767074 | U | 3/2013 |
| CN | 103206170 | A | 7/2013 |
| CN | 103967418 | A | 8/2014 |
| CN | 204703769 | U | 10/2015 |
| CN | 105401882 | A | 3/2016 |
| CN | 106194225 | A | 12/2016 |
| CN | 106988773 | A | 7/2017 |
| JP | 2015036467 | A | 2/2015 |

* cited by examiner

*Primary Examiner* — Wei Wang
(74) *Attorney, Agent, or Firm* — Wayne & Ken, LLC; Tony Hom

(57) ABSTRACT

Disclosed is an internal reamer for anchor shaft hole for mining, comprising a reaming cutter, a sleeve, a push-pull rod, a drilling machine connecting shaft and a manual hydraulic jack, wherein the push-pull rod is disposed in the sleeve coaxially, a rear end of the reaming cutter is connected to a front end of the push-pull rod, a rear end of the sleeve is connected with a guiding cylinder having an inner diameter larger than the sleeve, a rear end of the guiding cylinder is connected with a mounting cylinder coaxially, the manual hydraulic jack is installed in the mounting cylinder, a rear end of the push-pull rod is fixedly connected with a piston plate which is slidingly and sealingly matched with an inner wall of the guiding cylinder, and the front end of the drilling machine connecting shaft is fixedly connected with the rear end of the mounting cylinder.

3 Claims, 4 Drawing Sheets

INTERNAL REAMER FOR ANCHOR SHAFT HOLE FOR MINING

CROSS-REFERENCE TO RELATED APPLICATIONS

This application is a continuation of International Application No. PCT/CN2017/113700 with a filling date of Nov. 30, 2017, designating the United States, which claims priority to Chinese Application No. 201710389331.2 with a filling date of May 27, 2017. The content of the aforementioned applications, including any intervening amendments thereto, are incorporated herein by reference.

TECHNICAL FIELD

The present disclosure belongs to the technical field of roadway support, and particularly relates to an internal reamer for a mining anchor shaft.

BACKGROUND

The anchor shaft is used for the support of the underground roadway with the characteristics of simple structure, convenient construction and strong adaptability. In recent years, anchor shaft has become the main way of roadway support. However, in the engineering application of anchor shaft, failure of the anchor shaft is mainly represented as slip instability between the anchor shaft and the hole wall when encountering coal ash adhered to the hole wall or broken surrounding rock during the anchoring process.

In view of slip instability problem of the anchor shaft, some scholars have tried to solve the problem by using hole reaming method. However, for the existing reaming equipment, the tool part mostly is passively spread out to cut the rock to cause poor reaming performance. Also, there are problems like instability of reaming and difficult tool retraction. Therefore, it is proposed to use a reaming drill pipe with convenient use and stable reaming performance.

SUMMARY

In order to solve the deficiencies in the prior art, the present disclosure provides an internal reamer for anchor shaft hole for mining, which utilizes the principle of hydraulic power drive to realize the reaming and expansion of the hole wall or the hole bottom of the anchor shaft hole as well as an inverted conical shape of the hole, which is featured by active extension and retraction of the tool. It can improve the anchoring force of the anchor shaft in the process of anchoring and supporting the roadway, so as to improve the anchoring stability of the anchor shaft, overcome the slip instability of the anchor shaft, and finally realize the safe and efficient support of the mine and improve the safe production level of the mine.

In order to solve the above technical problems, the present disclosure adopts the following technical solutions. An internal reamer for a mine anchor shaft, comprising a reaming cutter, a sleeve, a push-pull rod, a drilling machine connecting shaft and a manual hydraulic jack, wherein the push-pull rod is disposed in the sleeve coaxially, the sleeve and the push-pull rod both are horizontally arranged in a front-rear direction, a rear end of the reaming cutter is connected to a front end of the push-pull rod, a front side of the sleeve is symmetrically provided with two elongated holes which are both opened along an axial direction of the sleeve, a front end of the sleeve is provided with a jack structure which drives the reaming cutter to extend beyond the elongated hole and to spread out, a rear end of the sleeve is fixedly connected with a guiding cylinder having an inner diameter larger than the sleeve, a rear end of the guiding cylinder is fixedly connected with a mounting cylinder coaxially, the manual hydraulic jack is fixedly installed in the mounting cylinder, a power pressing input assembly and a hydraulic oil returning handle of the manual hydraulic jack extend beyond the mounting cylinder, a power driving end of the power pressing input assembly is sleeved with a force-exerting rod, a rear end of the push-pull rod extends into the guiding cylinder and is fixedly connected with a piston plate which is slidingly and sealingly matched with an inner wall of the guiding cylinder, a piston rod of the manual hydraulic jack is connected with a rear side surface of the piston plate, the inner wall of the guiding cylinder is provided with two guiding grooves along an axial direction, an outer circumference of the piston rod is connected with a guiding block extending into and slidingly sealed in the guiding groove, and the front end of the drilling machine connecting shaft is fixedly connected with the rear end of the mounting cylinder, an outer circumference of the drilling machine connecting shaft is provided with an externally threaded structure, an inner wall of the sleeve is fixedly provided with at least two guiding sleeves which are sleeved outside the push-pull rod, and an outer diameter of the push-pull rod is equal to an inner diameter of the guiding sleeve The jack structure comprises a baffle and a jack cone, the baffle is fixedly disposed at a front end of the sleeve, a front end of the cone is fixedly connected with a rear side of the baffle, the reaming tool comprises a first reaming blade and a second reaming blade respectively corresponding to one elongated hole in a radial direction, rear ends of the first reaming blade and the second reaming blade are hinged at a front end of the push-pull rod through a pin shaft, the jack cone has a tapered shape with a thick front portion and a sharp rear portion, the first reaming blade and the second reaming blade form a scissors shape, a rear portion of the jack cone extends in between the first reaming blade and the second reaming blade, the pin shaft is sleeved with a torsion spring, two spring arms of the torsion spring respectively press the first reaming blade and the second reaming blade, under an action of the torsion spring, the jack cone respectively is press-fitted with the first reaming blade and the second reaming blade, outer sides of the first reaming blade and the second reaming blade are provided with stepped diamond teeth along a length direction, and thicknesses of the first reaming blade and the second reaming blade both are adapted to a width of the elongated hole.

One of the guiding sleeves is disposed on a rear side of the elongated hole, and the other of the guiding sleeves is disposed on a front side of the guiding cylinder.

With the above technical solution, during operation, the drilling machine connecting shaft of the present disclosure is firstly threaded with the power output shaft of the drilling machine. Then, the sleeve is pushed into the previously drilled anchor shaft hole, and the force-exerting rod is pressed to cause pressing of the input assembly. The piston rod of the manual hydraulic jack protrudes forward to push the piston plate to move forward along the inner wall of the guiding cylinder, and also the guiding block slides forward in the guiding groove. The push-pull rod slides forward in the guiding sleeve, and the first reaming blade and the second reaming blade hinged at the front end of the push-pull rod move forward. Since the sleeve does not move, as the first reaming blade and the second reaming blade move forward, the jack cone at the front end of the sleeve jacks off the first reaming blade and the second reaming blade and protrudes out from the two elongated holes, and the first reaming blade and the second reaming blade cut into the coal formation. The force-exerting rod is removed, the drilling machine is started, and the drilling machine connecting shaft is driven to rotate at a high speed. The drilling machine connecting shaft drives the sleeve to rotate through the mounting cylinder and the guiding cylinder in turn. Due to cooperation of the guiding block with the guiding groove and cooperation of the first reaming blade and the second reaming blade with respective elongated hole, when the sleeve and the mounting cylinder rotate, the push-pull rod can be driven to rotate at the same time, and the first reaming blade and the second reaming blade at the front end of the push-pull rod rotate along. The diamond teeth on the first reaming blade and the second reaming blade expand the bottom of the hole to a conical groove. In addition, when the rock layer is too hard, the push-pull rod can be pressed forward to having a greater resistance to start reaming of the drilling machine, then the rotation of the drilling machine is stopped. Then, the force-exerting rod is installed and is pressed, and the piston rod is extended to further spread out the first reaming blade and the second reaming blade. The process is repeated two to three times to achieve reaming. Finally, the drilling machine is stopped, the hydraulic oil return handle is operated to retract the piston rod, and the first reaming blade and the second reaming blade are retracted into the sleeve along the elongated holes under the action of the torsion spring. Finally the sleeve is pulled out to complete reaming operations.

The torsion spring of the present disclosure functions to retract the first reaming blade and the second reaming blade into the sleeve. The guiding sleeve functions to guide the push-pull rod to move back and forth. The guiding block on the rear side of the elongated hole serves to block the breakage of coal rock into the sleeve during the reaming process.

The cooperation of the guiding block with the guiding groove and the cooperation of the first reaming blade and the second reaming blade with respective elongated hole serve to transmit torque, so that the sleeve, the first reaming blade and the second reaming blade rotate simultaneously.

In summary, the present disclosure provides a drill pipe that utilizes a hydraulic drive principle to ream a hole wall or a hole bottom of a anchor shaft. The present disclosure is simple in operation, low in cost, stable in reaming performance, and the tool can be actively extended and retracted. It can effectively solve the problem of anchor shaft failure caused by the slip instability between the anchor shaft and the hole wall, can improve mining safety and improve mine production efficiency, which is of great significance to achieve safe and efficient mining and support for mining.

DETAILED DESCRIPTION OF EMBODIMENTS

Figure 1:
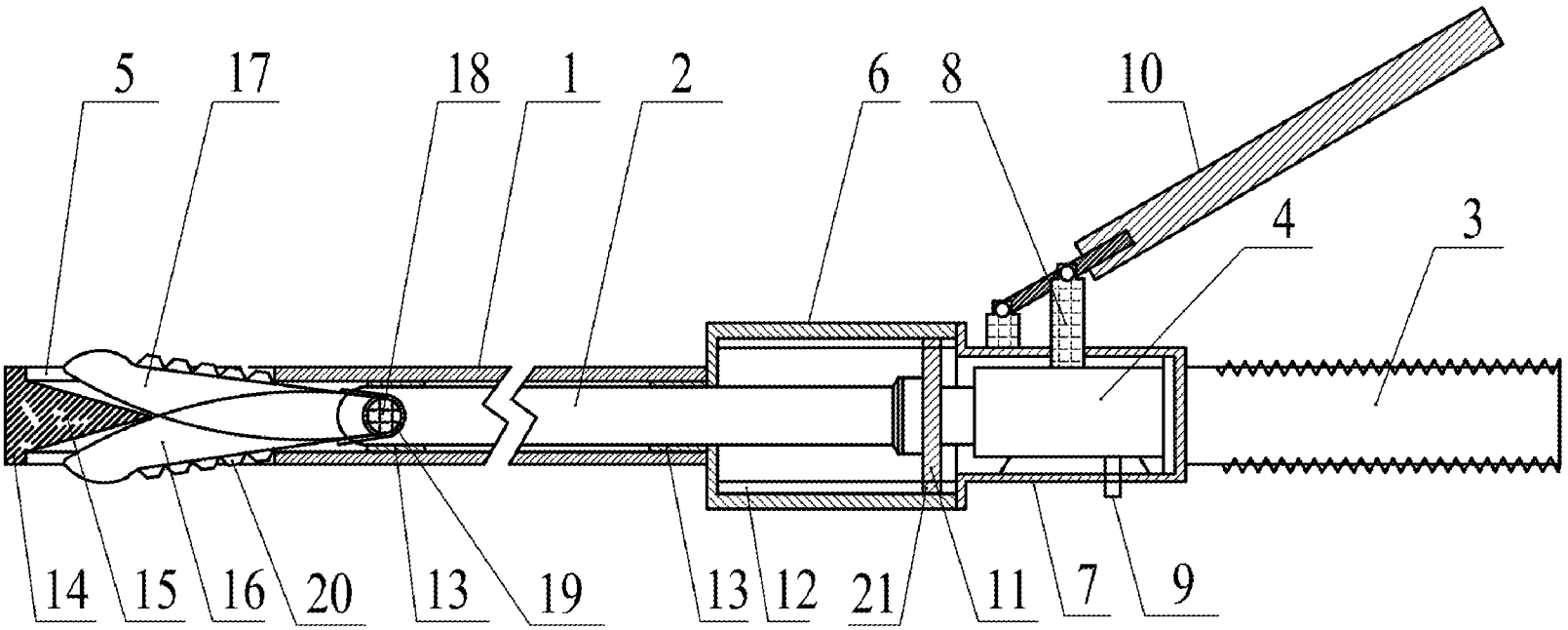
FIG. 1 is a schematic view of the overall structure of the present disclosure.
Figure 2:
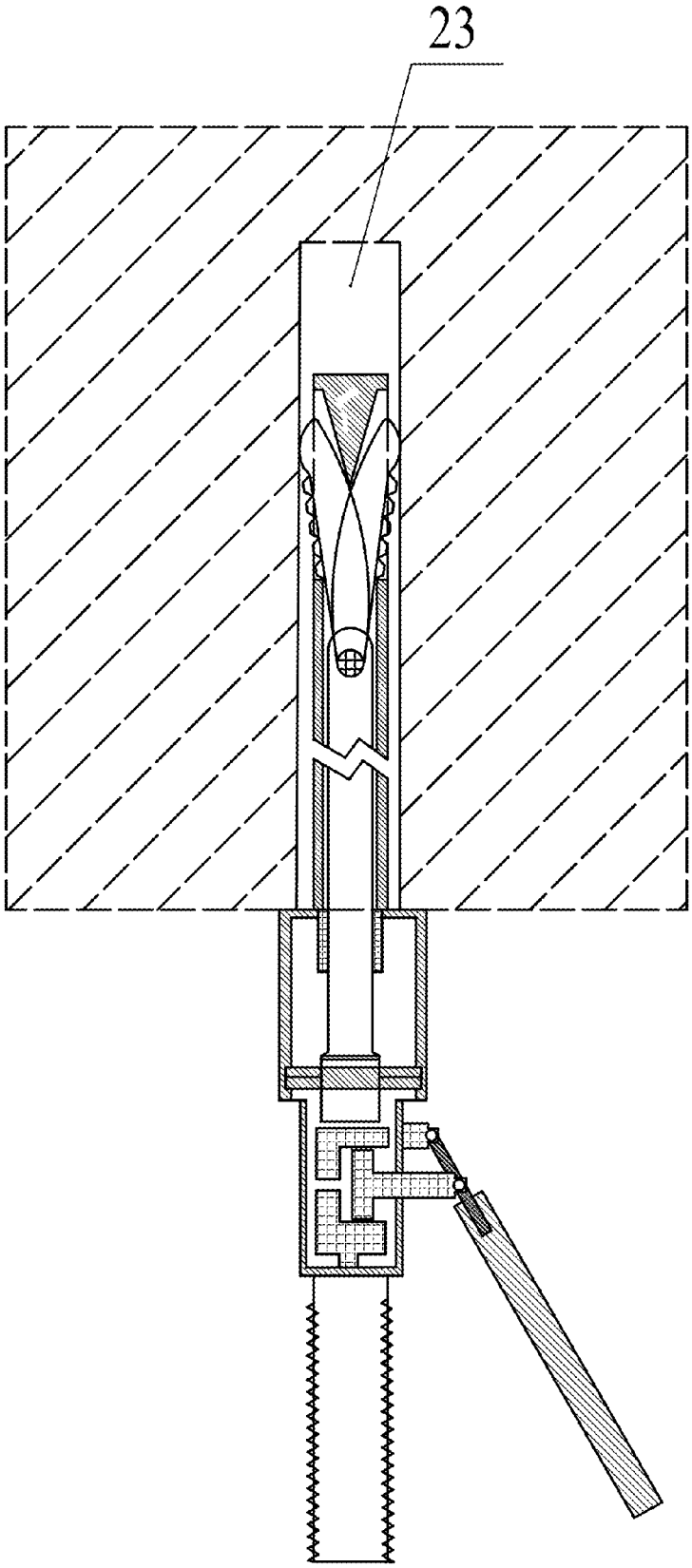
FIG. 2 shows a state of the anchor shaft before reaming.
Figure 3:
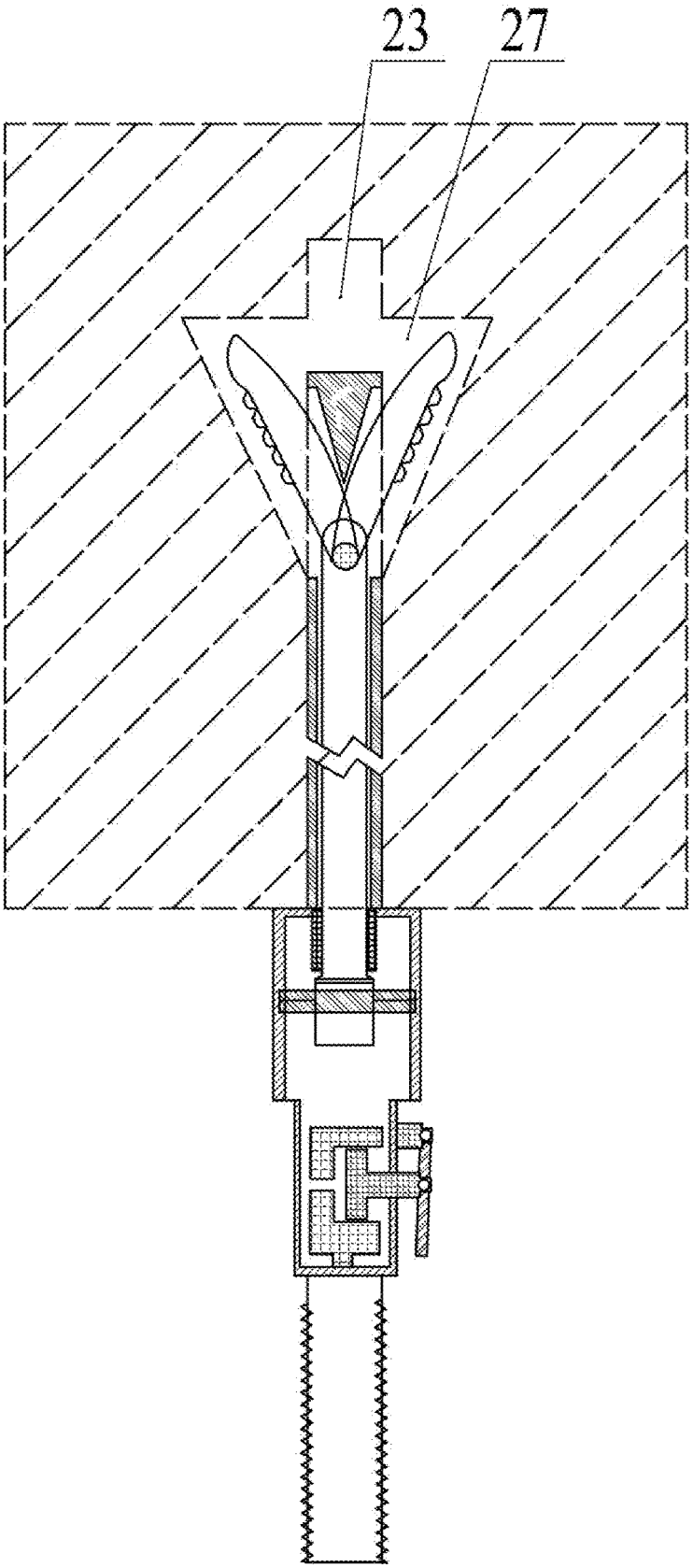
FIG. 3 shows a state of the anchor shaft after reaming.

As shown in FIG. 1 to FIG. 3, the internal reamer of the mine anchor shaft of the present disclosure comprises a reaming cutter, a sleeve 1, a push-pull rod 2, a drilling machine connecting shaft 3 and a manual hydraulic jack 4, wherein the push-pull rod 2 is disposed in the sleeve 1 coaxially, the sleeve 1 and the push-pull rod 2 both are horizontally arranged in a front-rear direction, a rear end of the reaming cutter is connected to a front end of the push-pull rod 2, a front side of the sleeve 1 is symmetrically provided with two elongated holes 5 which are both opened along an axial direction of the sleeve 1, a front end of the sleeve 1 is provided with a jack structure which drives the reaming cutter to extend beyond the elongated hole 5 and to spread out, a rear end of the sleeve 1 is fixedly connected with a guiding cylinder 6 having an inner diameter larger than the sleeve 1, a rear end of the guiding cylinder 6 is fixedly connected with a mounting cylinder 7, the manual hydraulic jack 4 is fixedly installed in the mounting cylinder 7, a power pressing input assembly 8 and a hydraulic oil returning handle 9 of the manual hydraulic jack 4 extend beyond the mounting cylinder 7, a power driving end of the power pressing input assembly 8 is sleeved with a force-exerting rod 10, a rear end of the push-pull rod 2 extends into the guiding cylinder 6 and is fixedly connected with a piston plate 11 which is slidingly and sealingly matched with an inner wall of the guiding cylinder 6, a piston rod of the manual hydraulic jack 4 is connected with a rear side surface of the piston plate 11, the inner wall of the guiding cylinder 6 is provided with two guiding grooves 12 along an axial direction, an outer circumference of the piston rod is connected with a guiding block 21 extending into and slidingly sealed in the guiding groove 12, and the front end of the drilling machine connecting shaft 3 is fixedly connected with the rear end of the mounting cylinder 7, an outer circumference of the drilling machine connecting shaft 3 is provided with an externally threaded structure, an inner wall of the sleeve 1 is fixedly provided with at least two guiding sleeves 13 which are sleeved outside the push-pull rod 2, and an outer diameter of the push-pull rod 2 is equal to an inner diameter of the guiding sleeve 13.

The jack structure comprises a baffle 14 and a jack cone 15, the baffle 14 is fixedly disposed at a front end of the sleeve 1, a front end of the cone is fixedly connected with a rear side of the baffle, the reaming tool comprises a first reaming blade 16 and a second reaming blade 17 respectively corresponding to one elongated hole 5 in a radial direction, rear ends of the first reaming blade 16 and the second reaming blade 17 are hinged at a front end of the push-pull rod 2 through a pin shaft 18, the jack cone 15 has a tapered shape with a thick front portion and a sharp rear portion, the first reaming blade 16 and the second reaming blade 17 form a scissors shape, a rear portion of the jack cone 15 extends in between the first reaming blade 16 and the second reaming blade 17, the pin shaft 18 is sleeved with a torsion spring 19, two spring arms of the torsion spring 19 respectively press the first reaming blade 16 and the second reaming blade 17, under an action of the torsion spring, the jack cone 15 respectively is press-fitted with the first reaming blade 16 and the second reaming blade 17, outer sides of the first reaming blade 16 and the second reaming blade 17 are provided with stepped diamond teeth 20 along a length direction, and thicknesses of the first reaming blade 16 and the second reaming blade 17 both are adapted to a width of the elongated hole 5.

One of the guiding sleeves 13 is disposed on a rear side of the elongated hole, and the other of the guiding sleeves is disposed on a front side of the guiding cylinder.

During operation, the drilling machine connecting shaft 3 of the present disclosure is firstly threaded with the power output shaft of the drilling machine. Then, the sleeve 1 is pushed into the previously drilled anchor shaft hole 23, and the force-exerting rod 10 is pressed to cause pressing of the input assembly 8. The piston rod of the manual hydraulic jack 4 protrudes forward to push the piston plate 11 to move forward along the inner wall of the guiding cylinder 6, and also the guiding block 21 slides forward in the guiding groove 12. The push-pull rod 2 slides forward in the guiding sleeve 13, and the first reaming blade 16 and the second reaming blade 17 hinged at the front end of the push-pull rod 2 move forward. Since the sleeve 1 does not move, as the first reaming blade 16 and the second reaming blade 17 move forward, the jack cone 15 at the front end of the sleeve 1 jacks off the first reaming blade 16 and the second reaming blade 17 and protrudes out from the two elongated holes 5, and the first reaming blade 16 and the second reaming blade 17 cut into the coal formation. The force-exerting rod 10 is removed, the drilling machine is started, and the drilling machine connecting shaft 3 is driven to rotate at a high speed. The drilling machine connecting shaft 3 drives the sleeve 1 to rotate through the mounting cylinder 7 and the guiding cylinder 6 in turn. Due to cooperation of the guiding block 21 with the guiding groove 12 and cooperation of the first reaming blade 16 and the second reaming blade 17 with respective elongated hole 5, when the sleeve 1 and the mounting cylinder 7 rotate, the push-pull rod 2 can be driven to rotate at the same time, and the first reaming blade 16 and the second reaming blade 17 at the front end of the push-pull rod 2 rotate along. The diamond teeth 20 on the first reaming blade 16 and the second reaming blade 17 expand the bottom of the hole to a conical groove 27. In addition, when the rock layer is too hard, the push-pull rod 2 can be pressed forward to having a greater resistance to start reaming of the drilling machine, then the rotation of the drilling machine is stopped. Then, the force-exerting rod 10 is installed and is pressed, and the piston rod is extended to further spread out the first reaming blade 16 and the second reaming blade 17. The process is repeated two to three times to achieve reaming. Finally, the drilling machine is stopped, the hydraulic oil return handle 9 is operated to retract the piston rod, and the first reaming blade 16 and the second reaming blade 17 are retracted into the sleeve 1 along the elongated holes 5 under the action of the torsion spring 19. Finally the sleeve 1 is pulled out to complete reaming operations.

Figure 4:
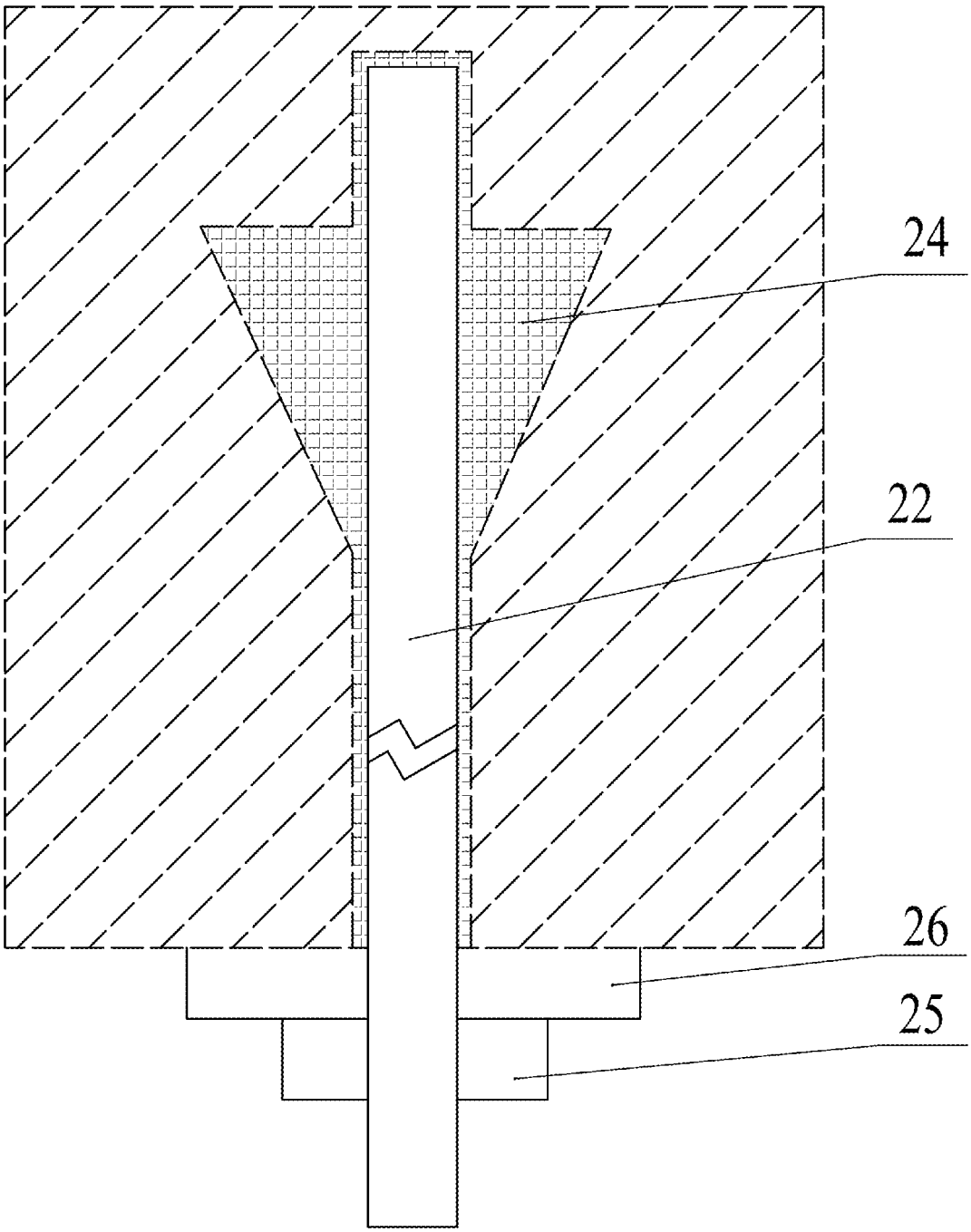
FIG. 4 shows a state after anchoring following reaming.

When the anchoring operation is performed, the anchor shaft 22 is inserted into the anchor shaft hole 23, and the anchoring agent 24 is injected into the anchor shaft hole 23. The conical groove 27 formed by reaming is also filled with the anchoring agent 24, the anchoring agent 24 is finally rotated by rotation, and the anchoring state of FIG. 4 is achieved. After the anchoring is secure, the backing plate 26 is sleeved on the anchor shaft 22 and threaded onto the anchor shaft 22 using a nut 25 to press the backing plate 26 against the wall of the roadway. In this way, the anchor shaft 22 and the inner wall of the anchor shaft hole 23 are more tightly coupled to prevent the anchor shaft 22 from moving or even being pulled out of the anchor shaft hole 23 and causing the anchor shaft 22 to fail.

The present disclosure is not limited to any form, material, structure or the like of the embodiments. Any simple modification, equivalent change and modification of the above embodiments according to the technical essence of the present disclosure are all within the protection range of the present disclosure.

What is claimed is:

1. An internal reamer for anchor shaft hole for mining, comprising a reaming cutter, a sleeve, a push-pull rod, a drilling machine connecting shaft and a manual hydraulic jack, wherein the push-pull rod is disposed in the sleeve coaxially, the sleeve and the push-pull rod both are horizontally arranged in a front-rear direction, a rear end of the reaming cutter is connected to a front end of the push-pull rod, a front side of the sleeve is symmetrically provided with two elongated holes which are both opened along an axial direction of the sleeve, a front end of the sleeve is provided with a jack structure which drives the reaming cutter to extend beyond the elongated hole and to spread out, a rear end of the sleeve is fixedly connected with a guiding cylinder having an inner diameter larger than the sleeve, a rear end of the guiding cylinder is fixedly connected with a mounting cylinder coaxially, the manual hydraulic jack is fixedly installed in the mounting cylinder, a power pressing input assembly and a hydraulic oil returning handle of the manual hydraulic jack extend beyond the mounting cylinder, a power driving end of the power pressing input assembly is sleeved with a force-exerting rod, a rear end of the push-pull rod extends into the guiding cylinder and is fixedly connected with a piston plate which is slidingly and sealingly matched with an inner wall of the guiding cylinder, a piston rod of the manual hydraulic jack is connected with a rear side surface of the piston plate, the inner wall of the guiding cylinder is provided with two guiding grooves along an axial direction, an outer circumference of the piston rod is connected with a guiding block extending into and slidingly sealed in the guiding groove, the front end of the drilling machine connecting shaft is fixedly connected with the rear end of the mounting cylinder, an outer circumference of the drilling machine connecting shaft is provided with an externally threaded structure, an inner wall of the sleeve is fixedly provided with at least two guiding sleeves which are sleeved outside the push-pull rod, and an outer diameter of the push-pull rod is equal to an inner diameter of the guiding sleeve.

2. The internal reamer for anchor shaft hole for mining according to claim 1, wherein the jack structure comprises a baffle and a jack cone, the baffle is fixedly disposed at a front end of the sleeve, a front end of the cone is fixedly connected with a rear side of the baffle, the reaming tool comprises a first reaming blade and a second reaming blade respectively corresponding to one elongated hole in a radial direction, rear ends of the first reaming blade and the second reaming blade are hinged at a front end of the push-pull rod through a pin shaft, the jack cone has a tapered shape with a thick front portion and a sharp rear portion, the first reaming blade and the second reaming blade form a scissors shape, a rear portion of the jack cone extends in between the first reaming blade and the second reaming blade, the pin shaft is sleeved with a torsion spring, two spring arms of the torsion spring respectively press the first reaming blade and the second reaming blade, under an action of the torsion spring, the jack cone respectively is press-fitted with the first reaming blade and the second reaming blade, outer sides of the first reaming blade and the second reaming blade are provided with stepped diamond teeth along a length direction, and thicknesses of the first reaming blade and the second reaming blade both are adapted to a width of the elongated hole.

3. The internal reamer for anchor shaft hole for mining according to claim 1, wherein one of the guiding sleeves is disposed on a rear side of the elongated hole, and the other of the guiding sleeves is disposed on a front side of the guiding cylinder.

* * * * *